US012180794B2

(12) United States Patent
Berge

(10) Patent No.: US 12,180,794 B2
(45) Date of Patent: Dec. 31, 2024

(54) TOOL AND A METHOD FOR AT LEAST ONE OF GRIPPING, EXPANDING, AND PENETRATING A WALL OF A BORE

(71) Applicant: E Holstad Holding AS, Sola (NO)

(72) Inventor: Thomas Berge, Stavanger (NO)

(73) Assignee: E Holstad Holding AS, Sola (NO)

( * ) Notice: Subject to any disclaimer, the term of this patent is extended or adjusted under 35 U.S.C. 154(b) by 0 days.

(21) Appl. No.: 17/766,418

(22) PCT Filed: Oct. 7, 2020

(86) PCT No.: PCT/NO2020/050245
§ 371 (c)(1),
(2) Date: Apr. 4, 2022

(87) PCT Pub. No.: WO2021/080434
PCT Pub. Date: Apr. 29, 2021

(65) Prior Publication Data

US 2024/0052716 A1 Feb. 15, 2024

(30) Foreign Application Priority Data

Oct. 21, 2019 (NO) ..... 20191257

(51) Int. Cl.
*E21B 31/20* (2006.01)
*E21B 23/01* (2006.01)
(Continued)

(52) U.S. Cl.
CPC ..... *E21B 23/01* (2013.01); *E21B 33/1291* (2013.01)

(58) Field of Classification Search
CPC ..... E21B 31/20; E21B 29/005; E21B 43/105; E21B 23/01; E21B 23/0411;
(Continued)

(56) References Cited

U.S. PATENT DOCUMENTS 1,897,985 A 2/1933 H.C.
2,142,017 A * 12/1938 Riemenschneider .. B21D 53/90 72/401
(Continued)

FOREIGN PATENT DOCUMENTS

CN 102575507 7/2012
EP 2616625 7/2013
(Continued)

OTHER PUBLICATIONS

Extended European Search Report for EP 20879213.5, dated Oct. 18, 2023.
(Continued)

*Primary Examiner* — Kenneth L Thompson
(74) *Attorney, Agent, or Firm* — Andrus Intellectual Property Law, LLP

(57) ABSTRACT

A tool and a method are for at least one of gripping, expanding, and penetrating a wall of a bore. The tool has a first tool part and a second tool part arranged axially movable relative to each other. The first tool part has a solid wedge, whereas the second tool part has at least one wedge arm. The first tool part further has at least one influencing portion configured to be radially movable upon contact with the at least one wedge arm of the second tool part. The at least one wedge arm is configured to be moved axially along the solid wedge so as to be forced radially outwards and thus push the at least one influencing portion radially outwards.

19 Claims, 13 Drawing Sheets

(51) Int. Cl.
*E21B 29/00* (2006.01)
*E21B 33/129* (2006.01)

(58) Field of Classification Search
CPC ..... E21B 23/04115; E21B 23/0412; E21B 23/0416; E21B 23/042; E21B 23/0421; E21B 23/0422
See application file for complete search history.

(56) References Cited

U.S. PATENT DOCUMENTS

| | | | | |
|---|---|---|---|---|
| 2,901,044 | A * | 8/1959 | Arnold | E21B 31/20 166/212 |
| 8,522,885 | B2 | 9/2013 | Giroux et al. | |
| 9,752,407 | B2 | 9/2017 | Jacob et al. | |
| 10,364,639 | B2 | 7/2019 | Svartvatn et al. | |
| 2004/0226724 | A1 | 11/2004 | Hirth | |
| 2005/0205305 | A1 | 9/2005 | Stout et al. | |
| 2006/0137877 | A1* | 6/2006 | Watson | E21B 29/005 166/55.8 |
| 2013/0312954 | A1 | 11/2013 | Crescenzo et al. | |
| 2015/0008041 | A1 | 1/2015 | Hall et al. | |
| 2016/0305215 | A1 | 10/2016 | Harris et al. | |
| 2017/0130553 | A1 | 5/2017 | Harris et al. | |

FOREIGN PATENT DOCUMENTS

| | | |
|---|---|---|
| EP | 3049610 | 4/2018 |
| RU | 2302515 | 7/2007 |
| RU | 2546695 | 4/2015 |
| RU | 2612392 | 3/2017 |
| RU | 2633596 | 10/2017 |
| WO | 97/20130 | 6/1997 |
| WO | 03/102354 | 12/2003 |
| WO | 2007/144719 | 12/2007 |

OTHER PUBLICATIONS

Norwegian Search Report for No. 20191257, dated Feb. 3, 2020.
International Search Report and the Written Opinion for PCT/No. 2020/050245, dated Jan. 4, 2021.

* cited by examiner (Fig. 1c in perspective)

(Fig. 1d in perspective)

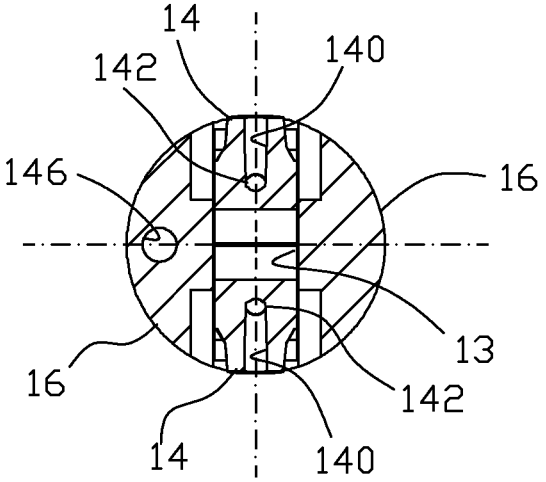
Fig. 4g H-H
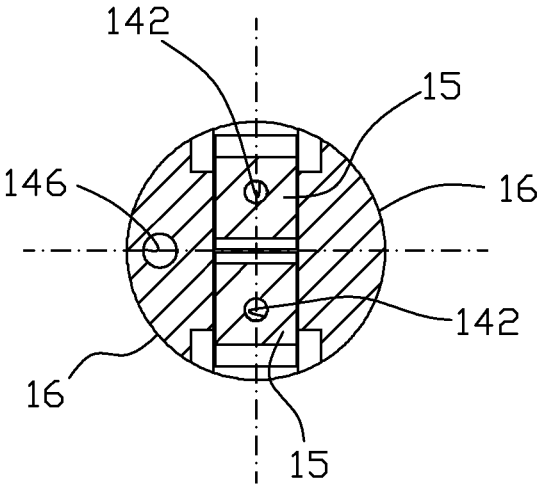
Fig. 4h I-I
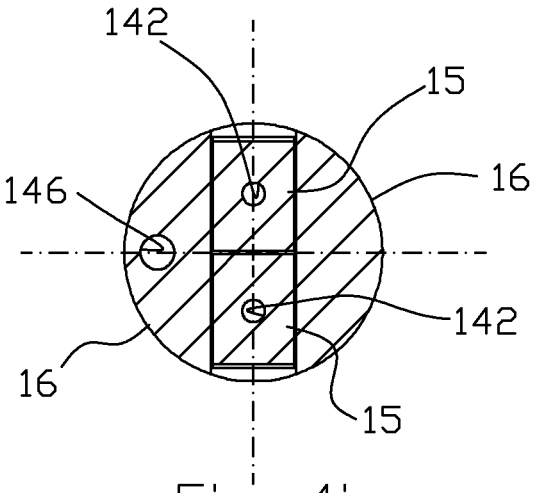
Fig. 4i J-J

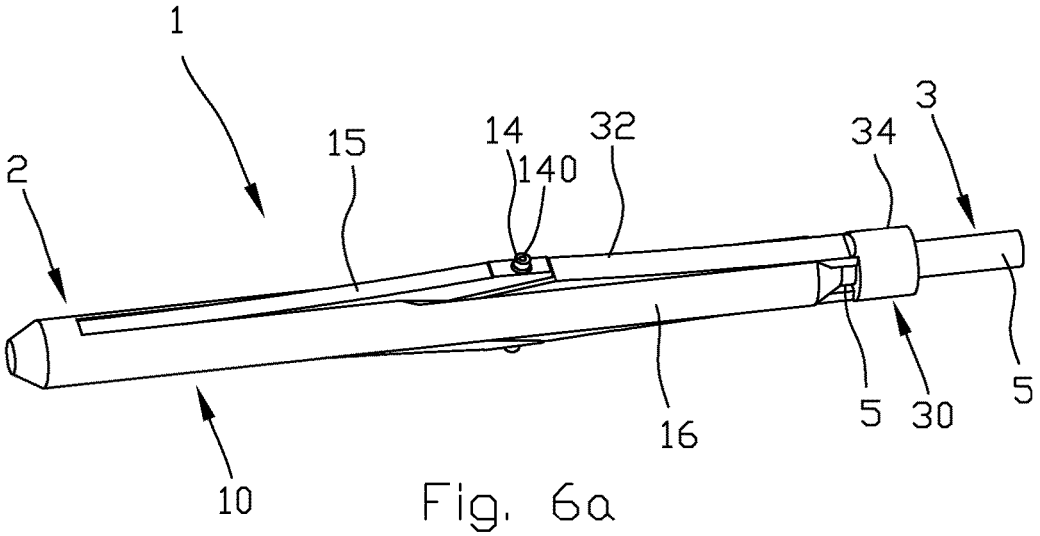
Fig. 6a
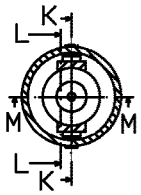
Fig. 6b
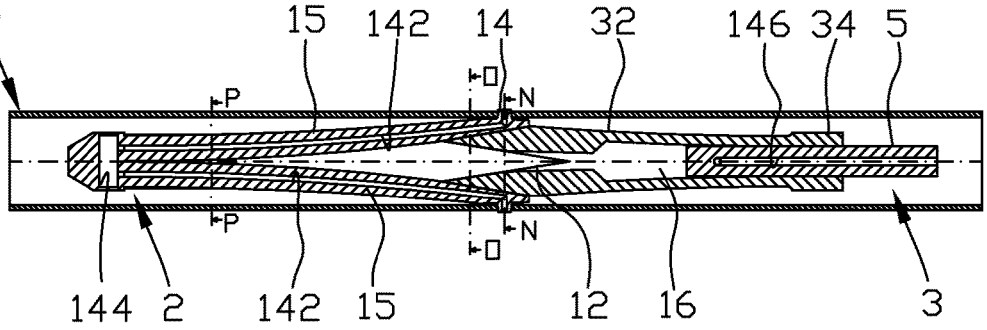
Fig. 6c K-K
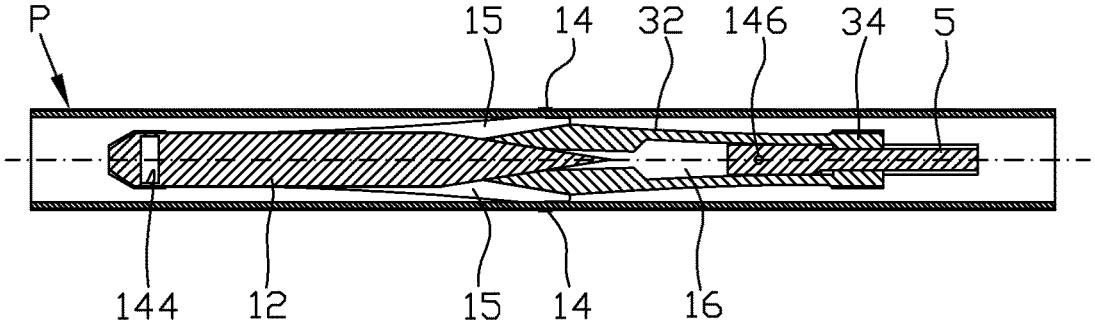
Fig. 6d L-L

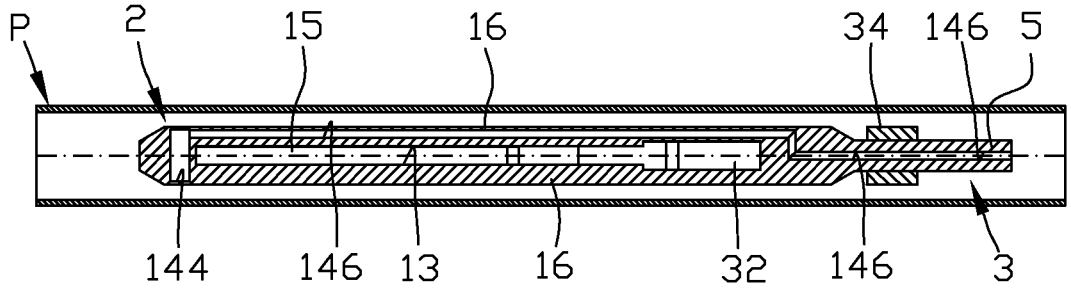
Fig. 6e M-M
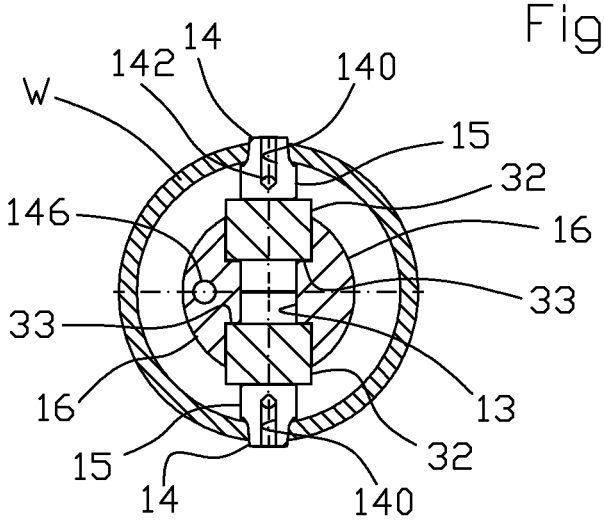
Fig. 6f N-N
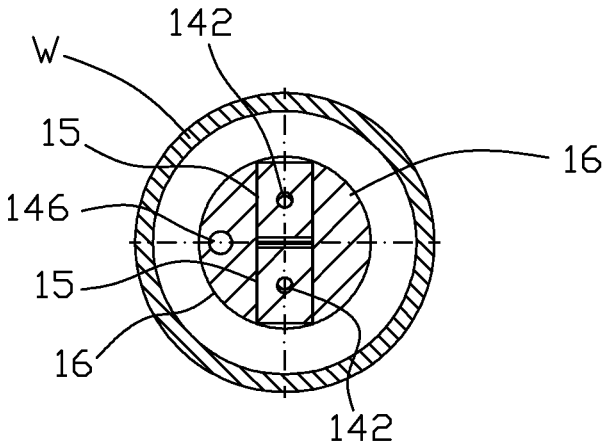
Fig. 6h P-P
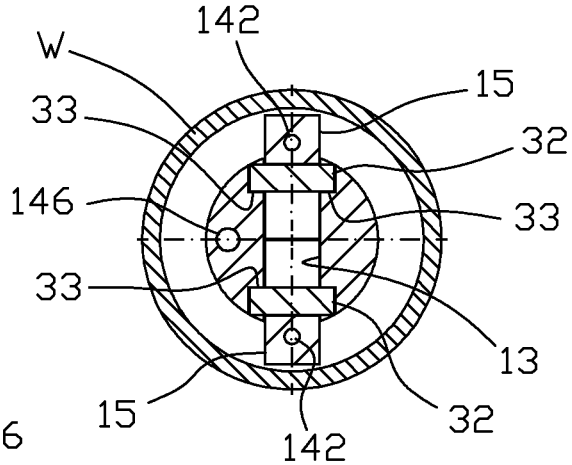
Fig. 6g □-□

TOOL AND A METHOD FOR AT LEAST ONE OF GRIPPING, EXPANDING, AND PENETRATING A WALL OF A BORE

CROSS-REFERENCE TO RELATED APPLICATIONS

This application is the U.S. national stage application of International Application PCT/NO2020/050245, filed Oct. 7, 2020, which international application was published on Apr. 29, 2021, as International Publication WO 2021/080434 in the English language. The International Application claims priority of Norwegian Patent Application No. 20191257, filed Oct. 21, 2019. The international application and Norwegian application are both incorporated herein by reference, in entirety.

FIELD

The present invention is related to a tool. More particularly, the invention relates to a tool for at least one of gripping, expanding, and penetrating a wall of a bore. The bore may be defined by for example a formation in a ground or by a pipe.

BACKGROUND

The tool according to the invention is especially suitable for use when there is a need for expanding or penetrating a pipe made of a ductile material, i.e. a material that allows a substantially local change in shape when subject to the tool. The tool according to the invention is also suitable for use as a centralizer or for hanging off the tool in a recess or a restriction, or for use as a slips anchor in a bore.

In what follows, the description is directed towards a pipe tool for expanding or penetrating a pipe wall in the oil and gas exploration industry. However, the tool is suitable for use in any industry wherein there may be a need for expanding or penetrating a pipe wall, for example.

In the oil and gas exploration industry, a production well that is no longer viable for production or requires closure for any other well bore issues, must be plugged to prevent the oil and gas reservoir fluids from migrating uphole over time and possibly contaminating other formations and or fresh water aquifers. The process of closing and leaving a production well is known as plugging and abandoning (P&A). A well is plugged by setting mechanical or cement plugs in the wellbore at specific intervals to prevent fluid flow.

An integrity of a plug is normally verified with a pressure test. Oftentimes, such a pressure test reveals that the oil or gas seeps past the plug. A leakage past for example through a plug provided by means of cement or other hardenable material may have several causes. However, the most common causes are typically due to one or both of insufficient filling of an annulus between the production string and the surrounding pipe or borehole, and insufficient adhesion between the plugging material and adjacent surfaces defining the annulus. Insufficient filling is typically caused by a production string being off centre with respect to the surrounding pipe or borehole, preventing the material filling the gap. Insufficient adhesion is typically due to residual well liquids or deposit preventing sufficient contact between the material and the surrounding surfaces.

Publication WO 2007/144719 discloses an expandable downhole tool for incorporation in a drill string, such as an under-reamer or a stabiliser. The tool is capable of being adjusted between activated and deactivated modes. To activate the tool, a ball or ball cluster can be launched down the drill string to trigger activation of the tool mechanically. Alternatively, a ball or ball cluster can be launched down the drill string to engage a seat and cause the tool to activate on increased pressure differential. The tool may be deactivated by means of hydraulic pressure. In one embodiment the tool is triggered into activation by launching of a deformable activator down the drill string. Subsequent deformation of the activator, to pass downwardly through a receiving seat, then allows the tool to reset itself automatically to the deactivated mode.

Publication EP2616625 discloses a perforating tool for perforating a downhole well casing, and a work string incorporating such a perforating tool. The tool comprises at least one movable cutter block. The cutter block is moved by means of an activation member that are activated by a plurality of pistons disposed in pressure chambers.

Publication U.S. Pat. No. 1,897,985 discloses a choke for oil wells, the choke comprising a tube smaller in exterior diameter than the well casing, a plurality of slips arranged circumferentially about the tube, a tapered mandrel in sliding engagement with the tube and tapered to force the slips outwardly against the casing, means on the mandrel for engaging tongs and means actuated by downward travel of the mandrel for releasing the tongs.

Publications RU 2612392, RU 2302515 and RU 2546695 show a first tool part and a second tool part axially movable with respect to the second tool part. The first tool part comprises a wedge and the second tool part comprises an influencing portion.

Operating expansion tool by means of a drill string or work string may be disadvantageous with respect to time, cost and control of the operation. Further, using drill pipe or coiled tubing for any washing and subsequent cementing operation, may sometimes be disadvantageous with respect to time, cost and control of the operation. It is therefore a trend in the industry to do the most "offline", i.e. without a using an expensive drilling rig. Any operation that can be executed by means of wireline will be preferred. However, in a situation where a drilling rig or coiled tubing is already rigged up on site, it may be impractical to rig up and down wireline equipment for a single operation. Therefore, the tool according may also be configured for being run on drill pipe or coiled tubing, even if running the tool on wireline is normally preferred.

There is a need in the industry for a tool that can be configured for wireline operation, alternatively coiled tubing or drill pipe operation. There is a further desire for a tool that may be configured for penetrating, washing and/or cementing an annulus surrounding for example a production tubing.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claim. The dependent claims define advantageous embodiments of the invention.

In a first aspect of the invention there is provided a tool for at least one of gripping, expanding, and penetrating a wall of a bore, the tool comprising a first tool part and a second tool part arranged axially movable relative to each other, wherein the first tool part comprises a solid wedge, whereas the second tool part comprises at least one wedge arm;

wherein the first and second tool parts are aligned so that a tip of the solid wedge is pointed towards a tip of the at least one wedge arm;

wherein the first tool part also comprises at least one influencing portion configured to be radially movable upon contact with the at least one wedge arm of the second tool part; and wherein when the tool is activated and the tool parts are forced against each other, the at least one wedge arm is configured to be moved axially along the solid wedge so as to be forced radially outwards and thus push the at least one influencing portion radially outwards for at least one of gripping, expanding, and penetrating the wall of the bore.

By the term influencing portion is meant a portion for gripping, expanding and/or penetrating the bore wall.

When the tool is configured for expanding and/or penetrating a bore, the bore is constituted by a pipe.

The wedge arm is wedged between the solid wedge and the influencing portion when the tool parts are forced towards each other.

Preferably, wherein a tip of the at least one wedge arm is shaped as a double wedge. By the term double wedge is meant a wedge that comprises two wedge faces, wherein one of the faces is slanted upwards with respect to a longitudinal axis of the wedge arm, and the other one of the faces is slanted downwards with respect to a longitudinal axis of the wedge arm. Thus, in a longitudinal sectional view, such a double wedge may have an "arrow"-like shape.

This has the effect that when the tool parts are forced against each other, the face of the double wedge sliding on the solid wedge urges the wedge arm radially outward with respect to a longitudinal axis of the tool. Further, the face of the double wedge abutting the influencing portion urges the influencing portion radially outwards with respect to the longitudinal axis of the tool. Thereby, a "triple effect" of radial movement is achieved, while maintaining axial structural integrity in expanded position.

This triple effect of radial expansion has the advantage that the tool may be slender with respect to a pipe string receiving the tool. The slenderer a tool is, the narrower constrictions within the pipe string may be passed by the tool.

In a prototype of the tool the tip of the influencing portion, the tip of the solid wedge and the tip of the double wedge of the wedge arm are arranged substantially next to each other at the centre line of the tool.

The influencing portion may be connected to the first tool part by means of a finger.

The finger may be a cantilevered finger, i.e. the finger may be cantilevered from the first tool part. In one embodiment the finger is cantilevered from an end portion of the first tool part comprising the solid wedge. A cantilevered finger may be made resilient to allow retraction of the influencing portion when the tool parts are moved axially away from each other, i.e. when the wedge arm is retracted. In an alternative embodiment, the finger connecting the influencing portion to the tool part comprising the solid wedge, may be connected by means a hinge, i.e. the finger may be hingedly connected to the first tool part.

In one embodiment the tool is configured such that when the tool is in an inactive position, the finger is positioned in a recess configured for housing or residing the finger. Thereby, the finger does not add to an outer dimension of the tool when the tool is in its passive position.

Preferably, when the tool is in an inactive position, a radial extent or protrusion of the influencing portion is substantially equal to or less than a radial extent or protrusion of the tool part to which it is connected, i.e. the first tool part. Thereby, the influencing portion does not, or only to a negligible degree, add to an outer dimension of the tool when the tool is in its passive position.

In an embodiment where the bore is a pipe, and when the tool is in an active position, the influencing portion is configured for expanding the wall of the pipe. By the term "in an active position" is meant any position wherein the influencing portion has a radial extent that is larger than a radial extent of the first tool part. In such an embodiment, the tool may be utilized for increasing an inner diameter of the pipe by radially expanding the pipe. In one embodiment, the tool may be provided with a plurality of fingers with influencing portions and corresponding wedge arms mutually spaced around a portion of the tool. By providing the tool with at least three influencing portions and wedge arms arranged around a periphery of the tool, the tool may be used for centring a first pipe with respect to a borehole or a second pipe surrounding the first pipe, or for centring and perforating a first pipe with respect to a borehole or a second pipe surrounding the first pipe.

In one embodiment, the influencing portion may be configured for expanding and perforates a pipe string by applying a local stress or point load exceeding the rupture stress of the pipe material.

In an embodiment where the bore is a pipe, the influencing portion may be configured for penetrating the wall of the pipe. In such an embodiment, the influencing portion may be provided with a protrusion or punching means that penetrates the wall of the pipe without substantially expanding the wall.

The finger may comprise two spaced-apart finger portions providing a space for housing or residing a portion of the solid wedge of the first tool part when the tool is in an inactive position. This has the effect that the finger portions may house a portion of the solid wedge.

In an embodiment wherein the tool is configured for gripping a wall of the bore, the influencing portion may comprise a serrated gripping face.

In one embodiment wherein the influencing portion is configured for penetrating the wall of the pipe, the influencing portion may be provided with an aperture being in fluid communication with a conduit configured for receiving an injection fluid from a source of injection fluid. An injection fluid may for example be a hardenable fluid such as cement or epoxy, or water, chemicals or a washing agent. Thus, the tool according to the invention may be used for injecting a fluid into an annulus between an outside of the pipe in which the tool has been inserted, and a surrounding wellbore or a second pipe. For a tool configured for injection of a fluid, it may be advantageous, but not necessary, to provide a finger having a relatively large cross-sectional area for housing a fluid supply channel. Thus, a "one-piece" finger instead of a finger comprising two finger portions as discussed above, is preferred. In order to reside such a one-piece finger, the solid wedge may comprise a recess configured for housing or residing the finger when the tool is in an inactive position.

In a second aspect of the invention, there is provided a method of at least one of gripping, expanding, and penetrating a wall of a bore, the method comprising:

providing a tool according to the first aspect of the invention for use in the method;

connecting the tool to a control device configured for operating the tool;

running the tool into the bore and down to a desired location within the bore;

activating the tool for at least one of gripping, expanding, and penetrating the wall of the bore.

When the wall of the bore has been influenced by the influencing portion, the method may further comprise deactivating the tool by bringing the tool to a radially passive or retracted position and moving the tool. The tool may be moved to a new location and activated for influencing the wall of the bore, or the tool may be pulled out of the bore.

When the bore is a pipe in a wellbore, the tool may be provided with an influencing portion, i.e. a portion for gripping, expanding and/or penetrating the bore wall, provided with an aperture being in fluid communication with a conduit configured for receiving an injection fluid from a source of injection fluid, and the method may further comprise injecting said fluid into an annulus defined between an outside of the pipe and a bore surrounding the pipe.

BRIEF DESCRIPTION OF THE DRAWINGS

In the following is described examples of preferred embodiments illustrated in the accompanying drawings, wherein:

FIG. 4*g* shows in larger scale a cross-sectional view through H-H in FIG. 4*d;*

FIG. 4*h* shows in larger scale a cross-sectional view through I-I in FIG. 4*d;*

FIG. 4*i* shows in larger scale a cross-sectional view through J-J in FIG. 4*d;*

FIG. 6*a* shows in the tool in FIG. 4*a* in a radially expanded position;

FIG. 6*b* is a principle cross-sectional view in smaller scale indicating a position of the longitudinal sectional views of FIGS. 6*c*-6*e* showing the tool arranged within a pipe;

FIG. 6*c* shows a sectional view through K-K in FIG. 6*b;*

FIG. 6*d* shows a sectional view through L-L in FIG. 6*b;*

FIG. 6*e* shows a sectional view through M-M in FIG. 6*b;*

FIG. 6*f* shows in larger scale a cross-sectional view through N-N in FIG. 6*c;*

FIG. 6*g* shows in larger scale a cross-sectional view through O-O in FIG. 6*c;*

FIG. 6*h* shows in larger scale a cross-sectional view through P-P in FIG. 6*c;*

DETAILED DESCRIPTION OF THE DRAWINGS

Figure 1A:
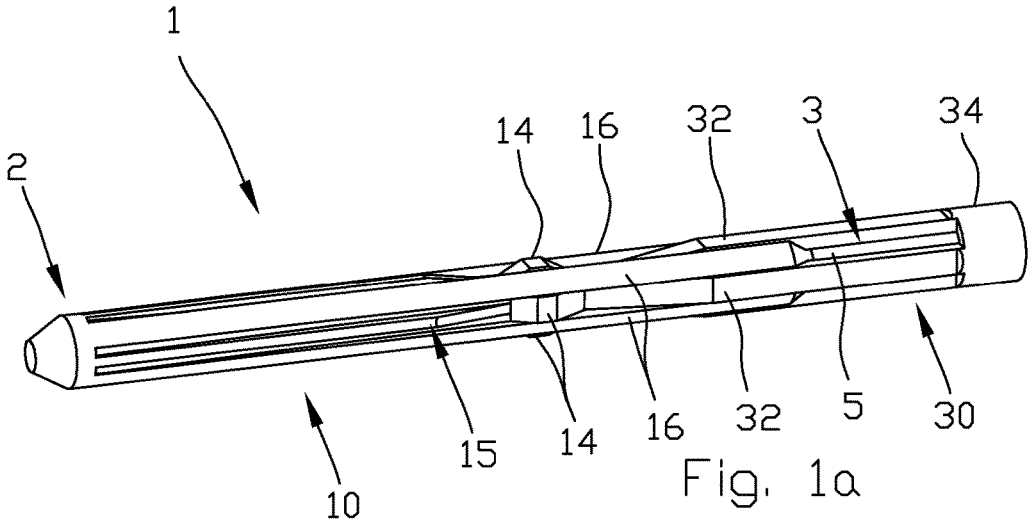
FIG. 1*a* shows a perspective view of a pipe tool according to the invention, wherein the tool is in a radially passive or retracted position.
Figure 1B:
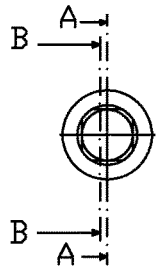
FIG. 1*b* is a principle view for indicating a position of the longitudinal sectional views of FIG. 1*c* and FIG. 1*d;*

Positional indications such as for example left and right, outwards and inwards, refer to the position shown in the figures.

In the figures, same or corresponding elements are indicated by same reference numerals. For clarity reasons some elements may in some of the figures be without reference numerals.

A person skilled in the art will understand that the figures are just principle drawings. The relative proportions of individual elements may also be strongly distorted.

In the figures, reference numeral 1 denotes a pipe tool according to the present invention.

Figure 1C:
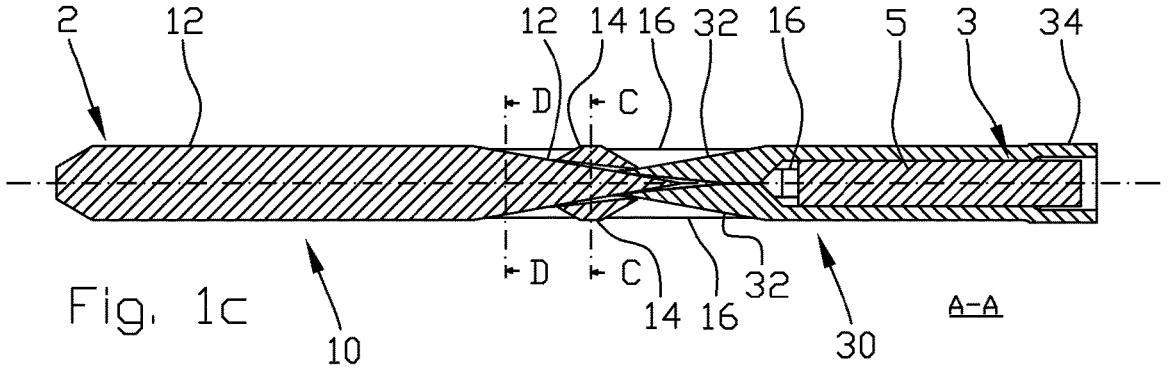
FIG. 1*c* shows a longitudinal sectional view through A-A in FIG. 1*b;*
Figure 1D:
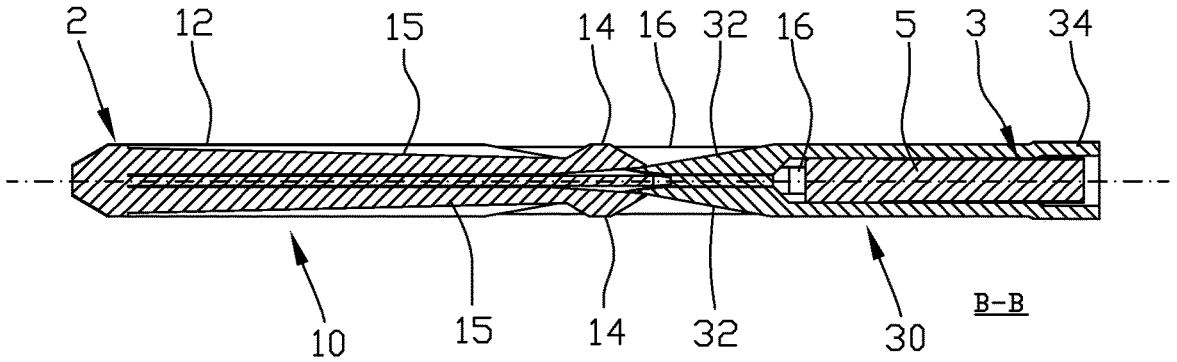
FIG. 1*d* shows an off centre longitudinal sectional view through B-B in FIG. 1*b;*
Figure 1E:
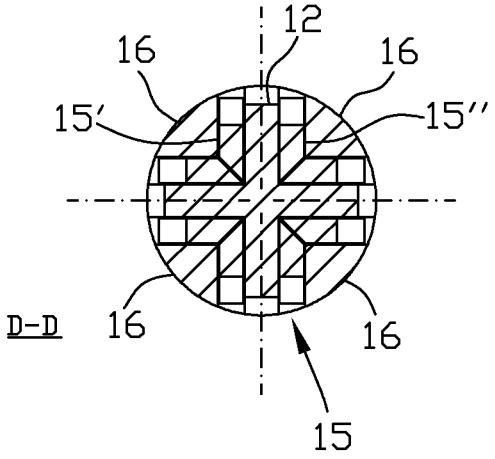
FIG. 1*e* shows in a larger scale a cross-sectional view through D-D in FIG. 1*c;*
Figure 1F:
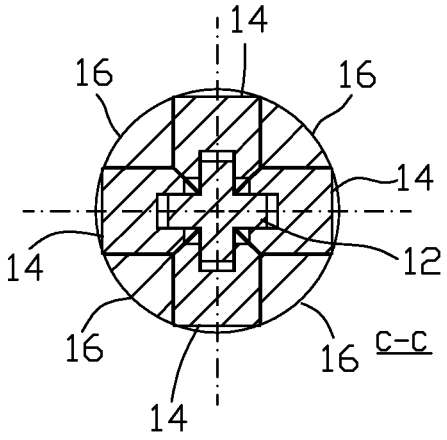
FIG. 1*f* shows in a larger scale a cross-sectional view through C-C in FIG. 1*c;*
Figure 1G:
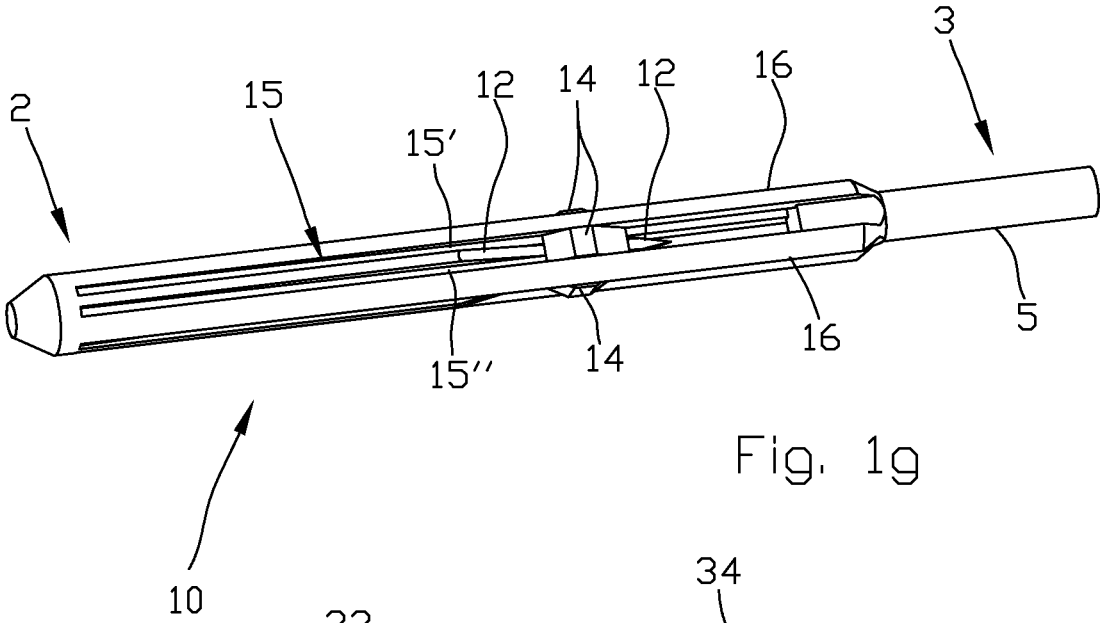
FIG. 1*g* shows a perspective view of a first portion of the pipe tool shown in FIG. 1*a;*

The pipe tool 1 comprises two tool parts, a first tool part 10 and a second tool part 30 which, for clarity, are shown individually in FIGS. 1*g* and 1 *h*, respectively.

As seen in FIG. 1*g*, the first tool part 10 has a first end portion 2 and a second end portion 3. The second end portion 3 comprises a rod 5. The rod 5 is connected to the first end portion 3 by means of body arms 16. In operation of the tool 1, the rod 5 serves as a means for transmitting force from an actuator operated from a distant location such as for example a rig on a surface.

Figure 1H:
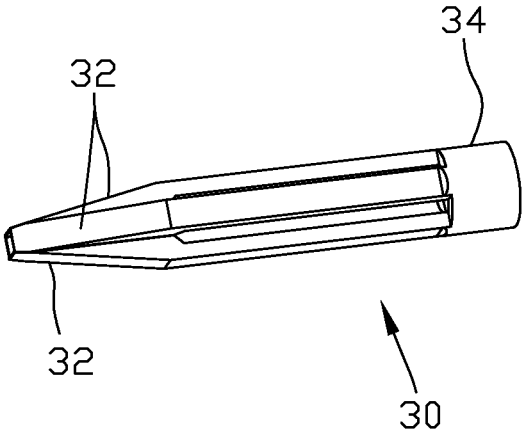
FIG. 1*h* shows a perspective view of a second portion of the pipe tool shown in FIG. 1*a;*

The second tool part 30 shown in FIG. 1*h* comprises elastic wedge arms 32 cantilevered from a sleeve 34. In the embodiment shown, the wedge arms 32 forms part of a split wedge. The wedge arms 32 are biased toward a passive or radially retracted position. In an alternative embodiment (not shown) the wedge arm may be hingedly connected to the sleeve 34 of the second tool part 30. However, a cantilevered wedge arm 32 is preferred as such an arm tends to be biased towards it passive or radially retracted position when the first tool part 10 and the second part 30 are moved axially away from each other. In an embodiment wherein the cantilevered wedge arm is made from a material being separate from that of the sleeve 34, the material can be selected to meet a desired biasing effect In all figures apart from FIGS. 1*g* and 1*h*, the tool 1 is shown assembled. At least a portion of the rod 5 is housed within the second tool part 30, and the body arms 16 of the first tool part 10 are intersected with the wedge arms 32 of the second tool part 30. The first tool part 10 and the second tool part 30 are arranged axially movable with respect to each other.

The first tool part 10 comprises a solid wedge 12 pointed towards a tip of the wedge arms 32 that form part of the split wedge.

An influencing portion 14 is connected to the first tool part 10 and radially movable by the wedge arm 32 of the second tool part 30. The wedge arm 32 is arranged to be forced radially outwards by the solid wedge 12 when the tool parts 10, 30 are moved axially against each other. By such a relative movement of the tool part 10, 30, the wedge arm 32 is configured for pushing or urging the influencing portion 14 radially outwards against a wall W of a pipe P for expanding or penetrating the pipe wall P, as shown for example in FIG. 3*b*.

In the embodiments shown, each influencing portion 14 is connected to the first tool part 10 by means of a finger 15 cantilevered from the first portion 2.

FIGS. 1*a*-2*b* show one embodiment of the tool 1 according to the present invention wherein the tool 1 is in a passive position with the influencing portions 14 (four shown in FIG. 1*f*) in a radially retracted or passive position.

In this passive position, the influencing portions 14 have a radial periphery or outer surface that are substantially the same as the periphery surface of the solid wedge 12 and periphery surface of a body arm 16 that connects the first end portion 2 with the second end portion 3 of the first tool part 10. Thus, the influencing portions 14 may be considered "housed" within a portion of the first tool part 10 when the tool 1 is in its passive position. This has the effect that the influencing portions 14 will slip past any obstruction or constriction as long as the first tool part 10 and the second tool part 30 will slip past such a constriction.

In the perspective view shown in FIG. 1*a*, the finger 15 that connects the influencing portion 14 to the first tool part 10 is, as mentioned above, cantilevered from the first end portion 2 of the first tool part 10. A cantilevered finger 15 may be formed from the same piece of material as the body arm 16 but is typically made from a separate piece of material mechanically connected to the first end portion 2. In an alternative embodiment (not shown) the finger 15 may be hingedly connected to the first end portion 2 of the first tool part 10. However, a cantilevered finger 15 is preferred as such a finger tends to be biased towards it passive or radially retracted position when the first tool part 10 and the second part 30 are moved axially away from each other. In an embodiment wherein the cantilevered finger 15 is made from a material being separate from that of the body arm 16, the material can be selected to meet a desired biasing effect.

In one embodiment (not shown) the finger 15 and the wedge arms 32 are configured with guiding means, such as for example keyways, for providing mechanical radial retraction of the finger 15 and the wedge arm 32 when the first tool part 10 and the second tool part 30 are moved axially away from each other.

Figure 2A:
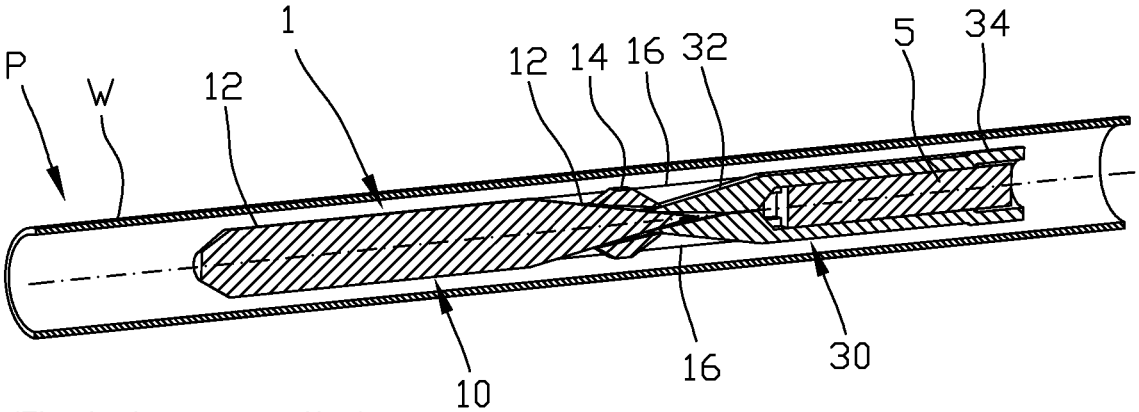
FIG. 2*a* shows in smaller scale a perspective view of the tool in FIG. 1*c* arranged within a portion of pipe.
Figure 2B:
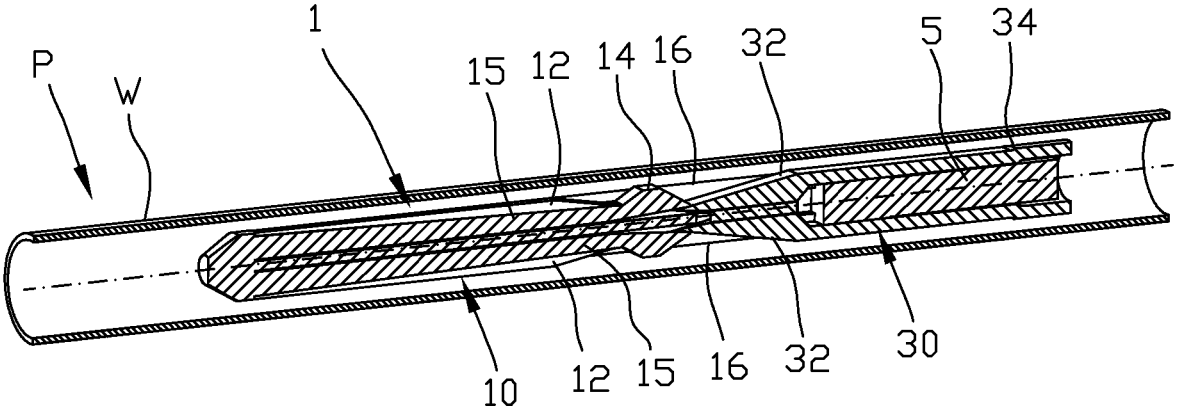
FIG. 2*b* shows in smaller scale a perspective view of the tool in FIG. 1*d* arranged within a portion of a pipe.

The longitudinal sectional views in FIGS. 1*c* and 2*b* show an end portion of the wedge arms 32 (two shown) gapping over a tip of the solid wedge 12, and the tip of each wedge arm 32 inserted between the solid wedge 12 and a portion of the influencing portion 14. Thus, in this initial position the wedge arms 32 are correctly arranged with respect to the solid wedge 12 and the influencing portion 14 for facilitating movement of the tool 1 towards its active position as shown for example in FIG. 3*a*.

The off centre longitudinal sectional view shown in FIGS. 1*d* and 2*b*, and the cross-sectional view shown in FIG. 1*e*, show an embodiment wherein the finger 15 that carries the influencing portion 14, comprises two parallel, spaced-apart finger portions 15', 15". A detail of the finger portions 15' and 15" are shown in FIG. 3*d*.

One purpose of the such a finger arrangement is to prevent the finger 15 from adding to the diameter of the tool when the tool 1 is in its retracted or passive position. This is achieved by providing recesses between the body arm 16 and the solid wedge 12 configured for receiving the finger portions 15' and 15". Thus, the finger 15 straddles a portion of the solid wedge 12 as best seen in FIG. 1*e*.

Another purpose of such a finger arrangement is to provide a common solid wedge capable of obtaining reaction forces from opposite fingers 15.

Figure 3A:
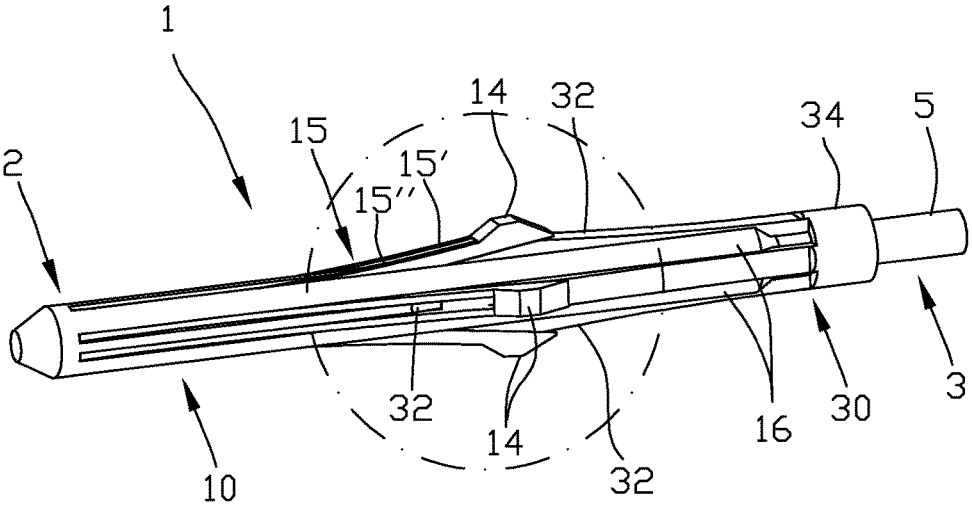
FIG. 3*a* shows the tool in FIG. 1*a* in a radially active or expanded position.
Figure 8A:
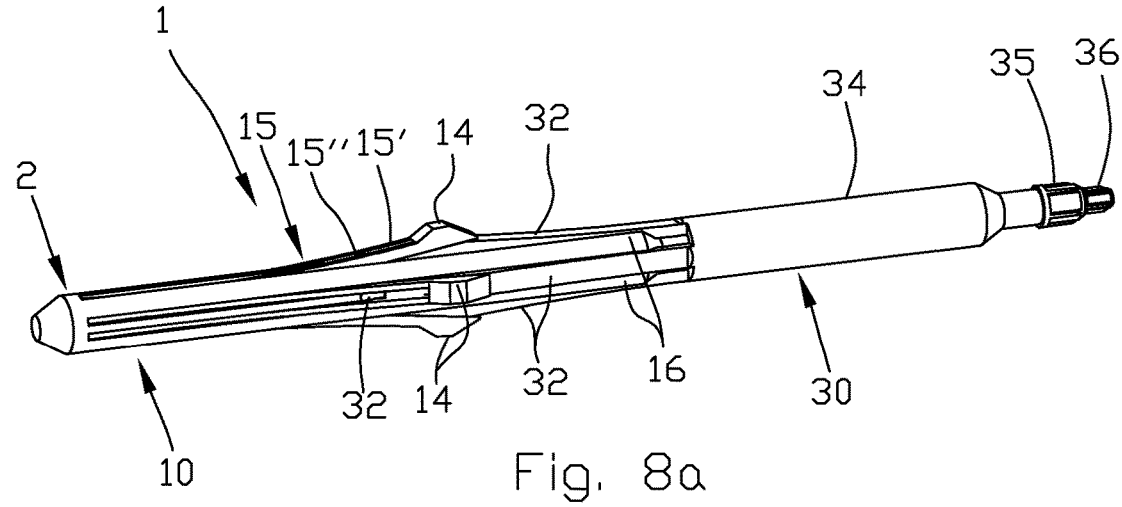
FIG. 8*a* shows an alternative embodiment of the tool shown in FIG. 3*a;*
Figure 8B:
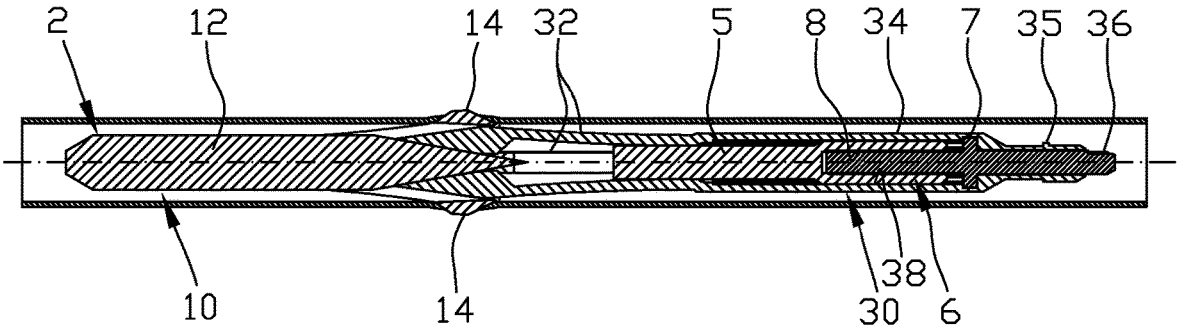
FIG. 8*b* shows a longitudinal sectional view of the tool shown in FIG. 8*a*, wherein the tool is arranged within a portion of a pipe.
Figure 9:
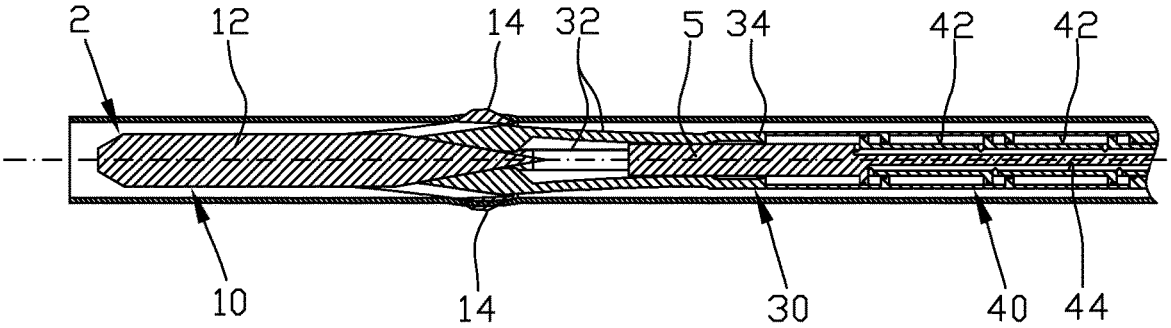
FIG. 9 shows a longitudinal sectional view of a tool provided with a hydraulic piston, wherein the tool is arranged within a portion of a pipe.

In FIG. 3*a*, the fingers 15 and the influencing portions 14 have been urged radially outward by forcing the first tool part 10 and the second tool part 30 that has been urged axially towards each. This is achieved by urging the rod 5, and thus all of the first tool part 10, with respect to the second tool part 30. This relative movement between the first tool part 10 and the second tool part 30 is activated by means of an external activator configured to hold the second tool part 30 while at the same time engaging and moving the rod 5 of the first tool part 10. In the embodiment shown in FIG. 3*a*, the first tool part 10 has been moved to the right with respect to the second tool part 30. It should be noted that the tool 1 is adapted to external activator available in the market. One such activator is shown in FIGS. 8*a* and 8*b*, while another type of actuator is shown in FIG. 9.

Figure 3B:
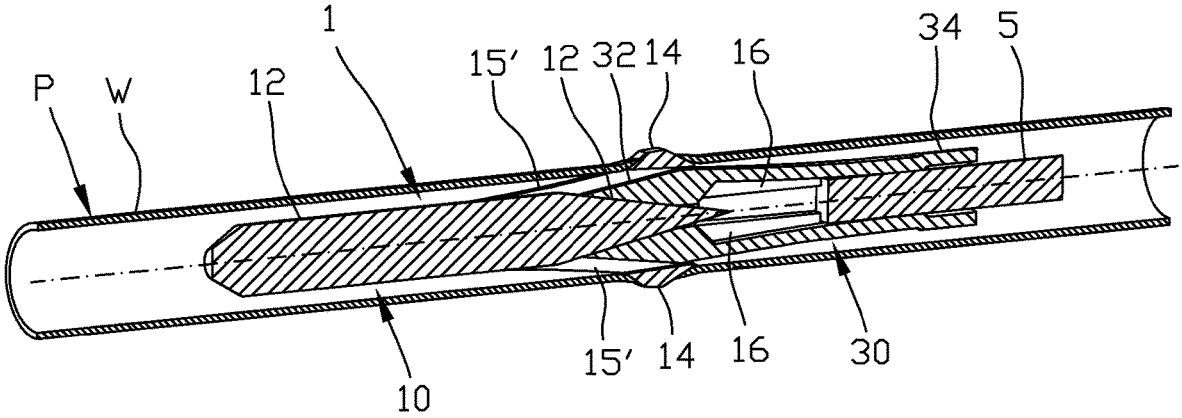
FIG. 3*b* shows the tool in FIG. 2*a* in a radially expanded position within a pipe, wherein a wall of the pipe has been penetrated.
Figure 3C:
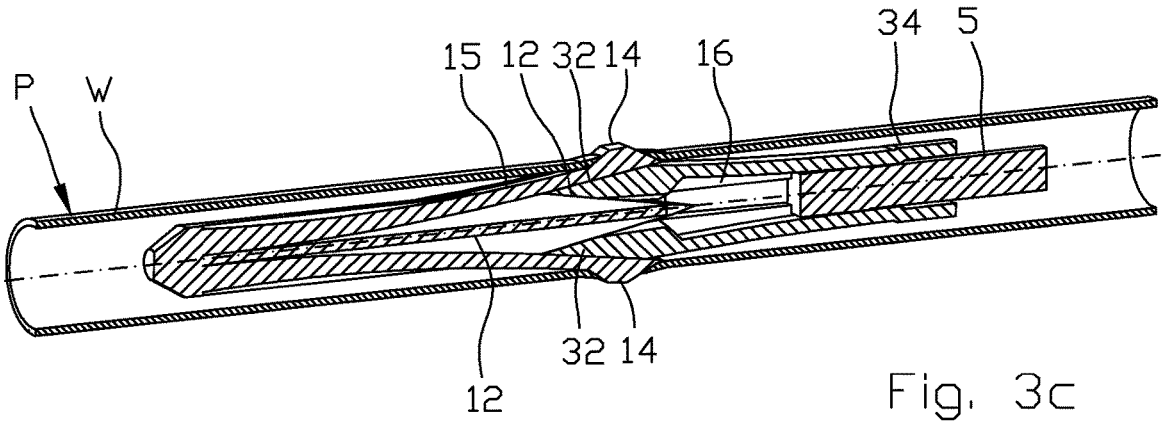
FIG. 3*c* shows the tool in FIG. 2*b* in a radially expanded position within a pipe, wherein a wall of the pipe has been penetrated.
Figure 3D:
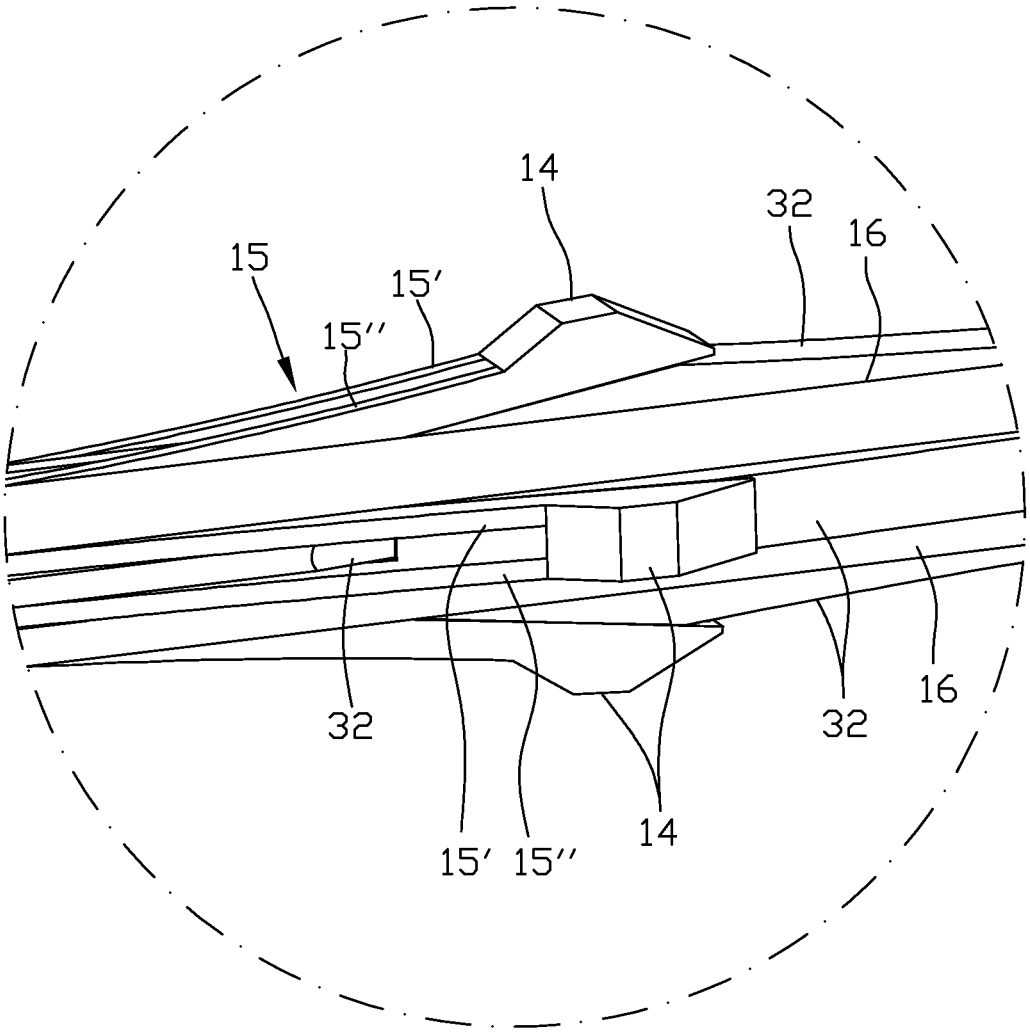
FIG. 3*d* shows in a larger scale a detail of FIG. 3*a;*

FIGS. 3*b* and 3*c* show the tool 1 after the influencing portions 14 have penetrated a wall W of a pipe P.

The influencing portions 14 are in FIGS. 1*a*-1*d*, 1*f*-3*d* shown with an outwardly facing surface being relatively small and flat. Such a configuration of the influencing portion 14 may typically be used when tool 1 is for expanding and penetrating a portion of the pipe wall W. However, if the purpose of the influencing portion 14 is to only expand the pipe wall, for example for centring a pipe P within an outer pipe or within a bore (neither shown), the outwardly facing surface of the influencing portion 14 would typically be made larger and/or the number of influencing portions 14 and appurtenant fingers 15, wedge arms 32 would be increased to avoid too high local stresses exceeding the rupture strength of the pipe material.

The apparatus 1 may be configured with less than the four influencing portions 14 shown, i.e. one, two or three, or more than four influencing portions 14.

FIGS. 4*a*-7*b* show an alternative embodiment of the tool 1 according to the present invention wherein the tool 1 is configured for penetrating a wall W of a pipe P and injecting a fluid through the wall of the pipe P via the influencing portion 14. The fluid may for example be a cleaning fluid for cleaning surfaces in an annulus defined by on the outside of the pipe P and another pipe or a borehole surrounding the pipe P, or it may be hardenable plugging material for plugging the annulus.

In this alterative embodiment, the function of the solid wedge 12 and the wedge arm 32 is in principle the same as for the tool shown in FIGS. 1*a*-3*c*. However, in the alterative embodiment there are shown only two fingers 15 and thus only two influencing portions 14. Although only two fingers 15 and influencing portions 14 are shown in FIGS. 4*a*-7*b*, it should be noted that the tool 1 alternatively may be provided with more than two fingers 15 and influencing portions 14, or only one influencing portion 14 configured for injecting a fluid as described above. In still another embodiment, there may be a combination of at least one influencing portion for injecting a fluid, and at least one influencing portion 14 of the type shown in FIGS. 1*a*-1*d*, 1*f*-3*d*.

Each influencing portion 14 shown in FIGS. 4*a*-7*b* comprises a protrusion in the form of a lug or knob. Each knob 14 (and thus each influencing portion) is provided with an aperture 140 or channel being in fluid communication with a conduit 142 configured for receiving an injection fluid from a source of injection fluid.

Figure 4A:
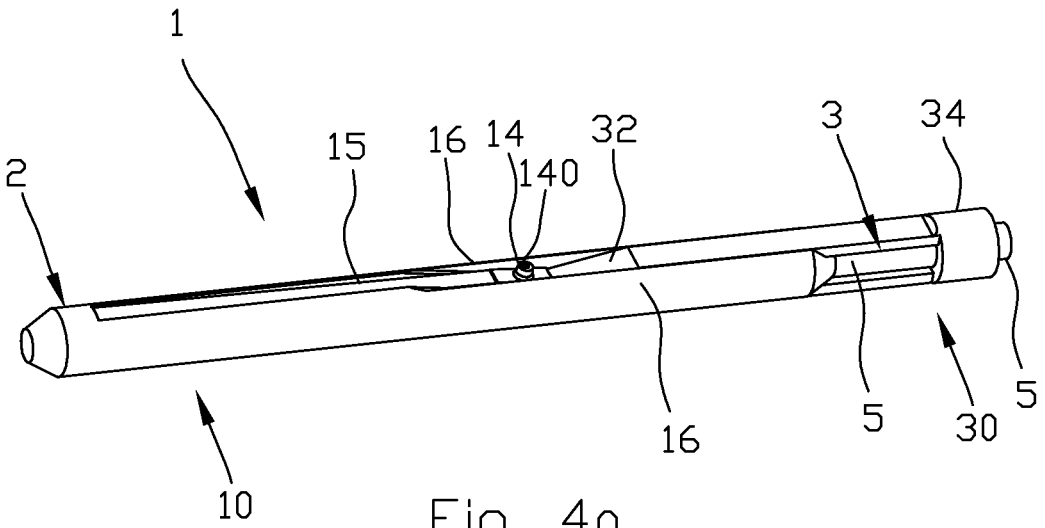
FIG. 4*a* shows an alternative embodiment of the tool shown in FIG. 1*a;*
Figure 4B:
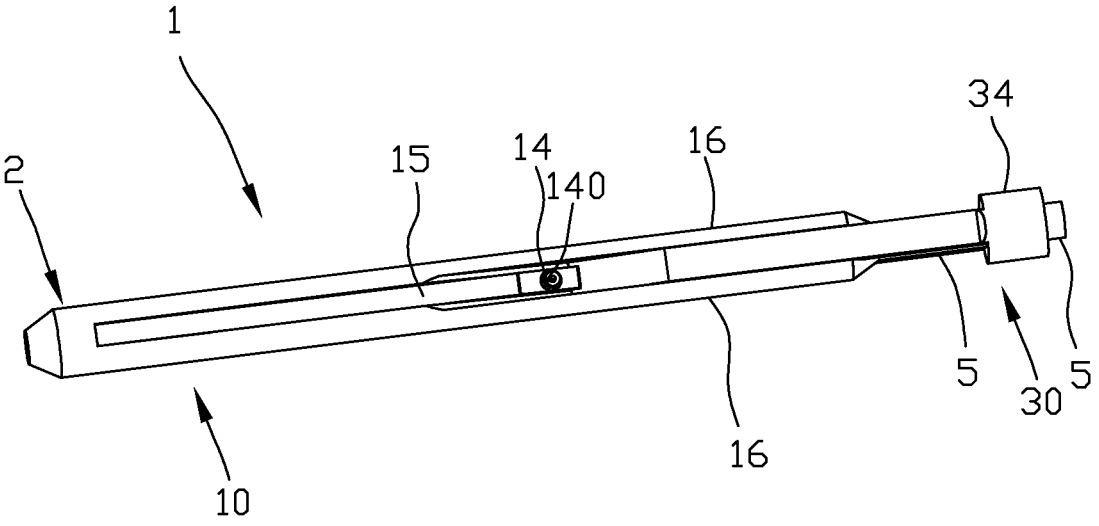
FIG. 4*b* shows the tool in FIG. 4*a* in a slightly different view angle and rotated some degrees around its longitudinal axis.
Figure 4D:
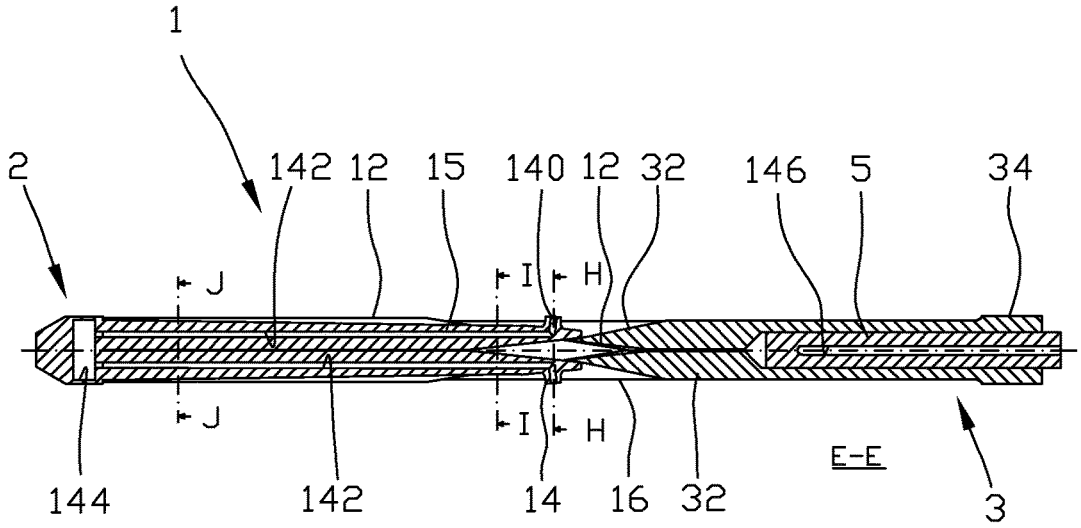
FIG. 4*d* shows a sectional view through E-E in FIG. 4*c;*
Figure 4C:
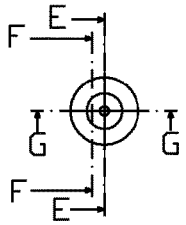
FIG. 4*c* is a principle view indicating a position of the longitudinal sectional views of FIGS. 4*d*-4*f;*
Figure 4E:
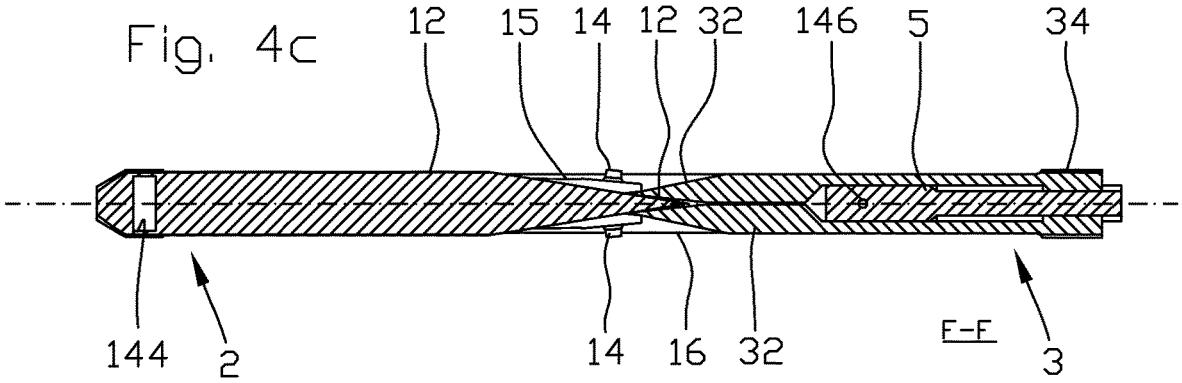
FIG. 4*e* shows a sectional view through F-F in FIG. 4*c;*
Figure 5A:
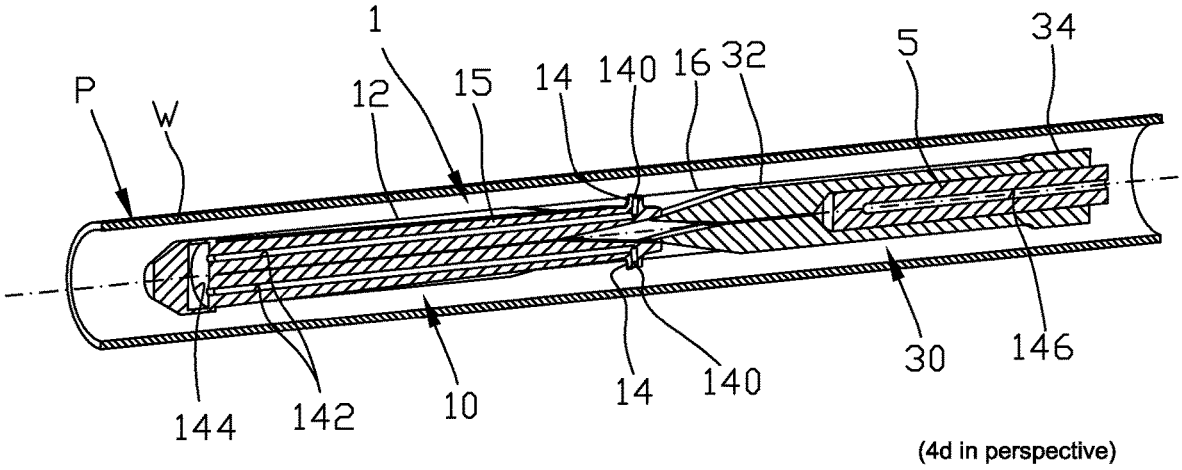
FIG. 5*a* shows a perspective view of the tool in FIG. 4*d* arranged within a portion of pipe.
Figure 5B:
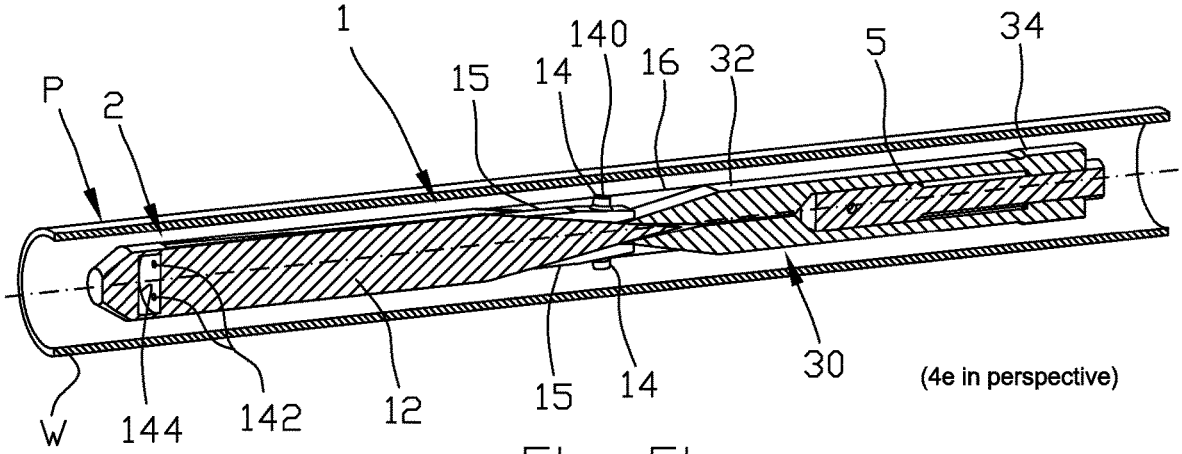
FIG. 5*b* shows a perspective view of the tool in FIG. 4*e* arranged within a portion of a pipe.
Figure 7A:
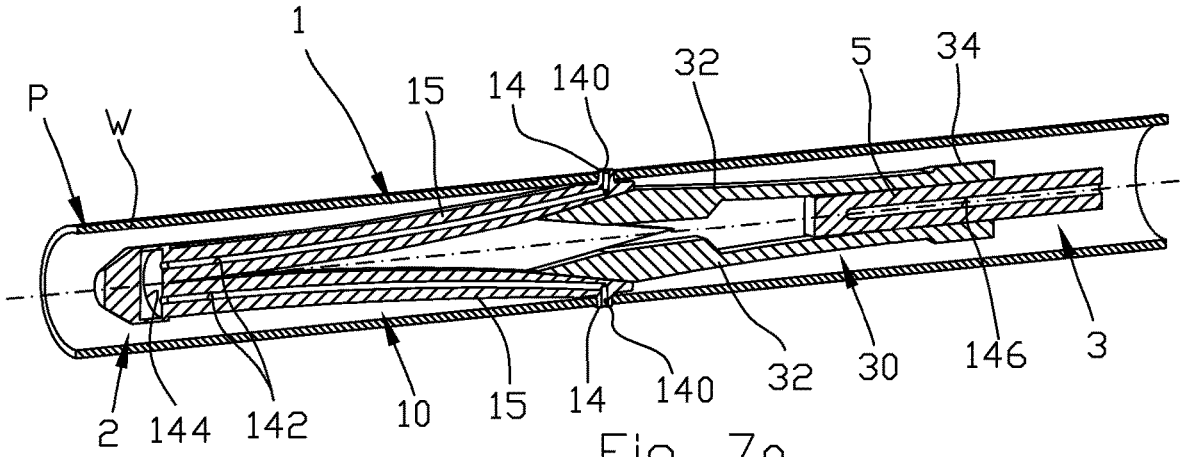
FIG. 7*a* shows a perspective view of the tool in FIG. 6*c;*
Figure 7B:
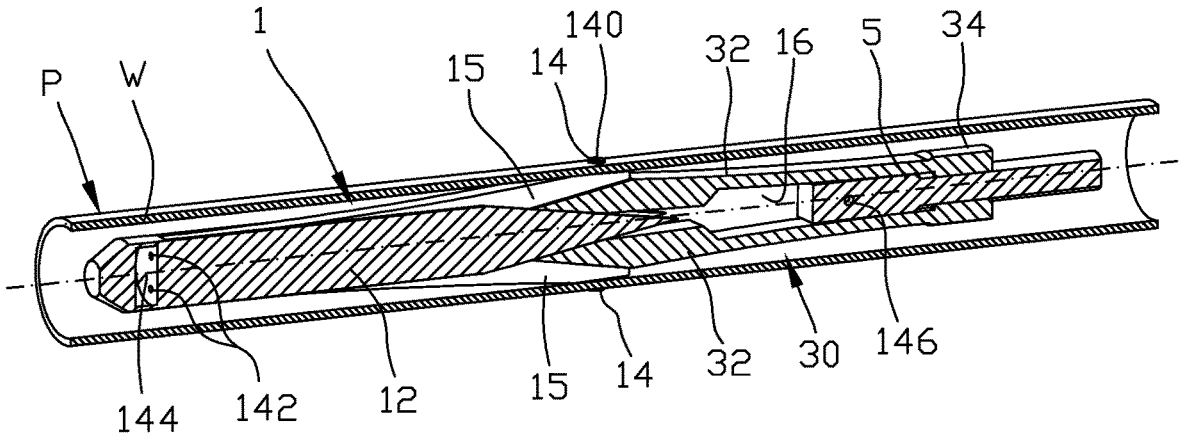
FIG. 7*b* shows a perspective view of the tool in FIG. 6*d;*

As seen in FIGS. 4*d*, 5*a* and 6*c*, each conduit 142 extends within the finger 15 from the aperture 140 in the knob 14, to a distribution reservoir 144.

Figure 4F:
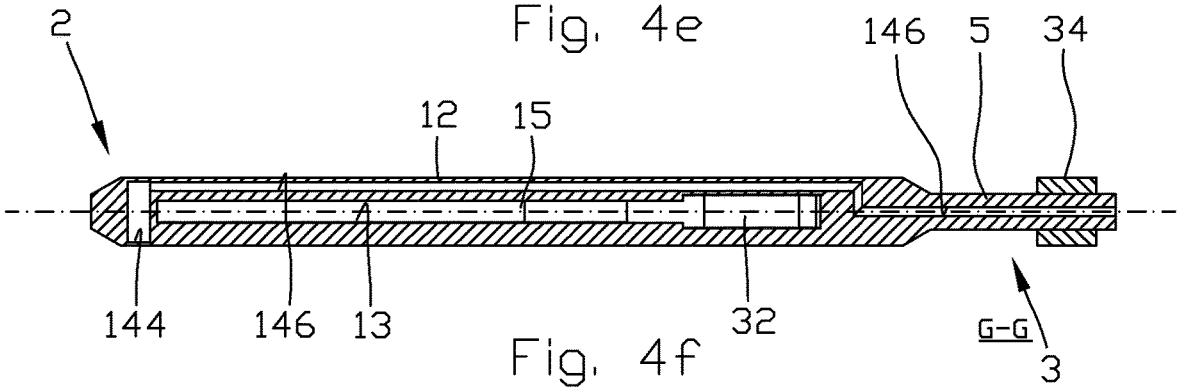
FIG. 4*f* shows a sectional view through G-G in FIG. 4*c;*

As shown in FIGS. 4*f* and 6*e*, the distribution reservoir 144 is in fluid communication with a fluid supply channel 146 extending through body arm 16 (see FIGS. 4*g*-4*i* and 6*f*-6*h*) providing axial connection between the first end portion 2 and the second end portion 3 of the first tool part 10. The fluid supply channel 146 is configured for receiving fluid from a pressurised fluid source (not shown) that may be arranged at a surface, such as a surface rig (not shown). A fluid from the surface is typically supplied to the tool 1 by means of coiled tubing or drill pipe. As an alternative to supplying the fluid from a surface, the fluid may be supplied from a downhole fluid container such as for example a canister (not shown) connected to the tool 1, and a pump system controlled from the surface. A downhole fluid supply system comprising a canister and pump of this type is commercially available in the marked.

In FIGS. 4*a*-5*b*, the tool 1 is in its passive or retracted position. In FIGS. 6*a*-7*b* the tool 1 is in its active or expanded position. FIGS. 6*b*-6*d*, 6*f* and 7*a*-7*b* show the influencing portion or knob 14 penetrating a wall W of a pipe P. In the embodiment shown the knob 14 provides a sufficient sealing against the wall W.

In the embodiment shown in FIGS. 4*a*-7*b* wherein the influencing portion or knob 14 is configured for communicating a fluid, each finger 15 is a "one-piece" finger instead of a finger comprising to finger portions 15', 15" as discussed above. Due to its cross-sectional area, a one-piece finger 15 is better suited for housing the fluid conduit 142 than a finger comprising two finger portions 15', 15" with a smaller cross-sectional area. In order to reside such a one-piece finger 15, the solid wedge 12 is configured with recesses 13 configured for residing the fingers 15 when the tool 1 is in an inactive position as shown in FIGS. 4*a*-5*c*.

The recesses 13 in the solid wedge 12 are best seen in FIGS. 4*f*, 6*f* and 6*g*. A width of the recess 13 is larger than a width of the solid wedge 12 to allow the finger 15 to reside within the recess 13 when the tool 1 is in its passive position, but smaller than a width of the wedge arm 32 to allow the wedge arm 32 to be urged radially outwards by the solid wedge when the tool parts 10, 30 are forced against each other.

FIGS. 8*a* and 8*b* show an embodiment of the tool 1 wherein the second tool part 30 houses a rod driving means 6. The rod driving means 6 (see FIG. 8*b*) comprises a flange 7 having an outer portion that resides in a corresponding recess in an inner wall of sleeve 34 of the second tool part 30. Thus, the rod driving means 6 is configured for rotating, but prevented from axial movement with respect to the sleeve 34. A portion of the rod driving means 6 is in threaded engagement with a threaded bore 8 in a portion of the rod 5, and the rod 5 is axially movable but prevented from rotation with respect to the sleeve 34 by means of splines 38, as shown in FIG. 8*b*. An end portion of the sleeve 34 is provided with a neck 35 fixedly secured thereto. The neck 35 that is fixed to the sleeve 34, is designed for connection to a manipulation tool (not shown) configured for engaging a rotatable end portion 36 of the driving means 6. Thus, when the manipulation tool is engaged to rotate the rod driving means 6, the rod 5 will be moved in an axial direction. The second tool part 30 connected to the manipulation tool is held stationary, while the first tool part 10 is moved axially with respect to the second tool part 30. The direction of the axial movement is controlled by controlling rotational direction of the manipulation tool. Examples of manipulation tools suitable for controlling the tool 1 according to the present invention is disclosed in the publication EP 3049610 and in U.S. Pat. No. 10,364,639.

One advantage of the rod driving means 6 operable by a rotatable manipulation tool is that an operator may obtain exact information or feedback in real time of a radial position of the influencing portion 14. The thread pitch of the threaded connection between the rod driving means 6 and the threaded bore 8 of the rod 5, and the angles of inclination of the wedges 12, 32 configured for abutting each other and the influencing portion 14, are known for each tool. By providing the manipulation tool and/or the rod driving means 6 with a counting device configured for counting the number of revolutions the position of the influencing portions 14 may be calculated, typically by means of a computer receiving input data from the counter, as will be appreciated by a person skilled in the art.

In an alternative embodiment shown in FIG. 9, an axial movement of the rod 5 may be provided by means of a controllable hydraulic piston 40 arranged as an extension to the sleeve 34. The hydraulic piston 40 comprises a plurality of annular piston chambers 42 being in fluid communication with an annular fluid communication conduit 44. The fluid communication conduit 44 may in one embodiment be in fluid communication with a fluid line extending to a remote location, such as for example a rig. Alternatively, the fluid conduit may be in fluid communication with a canister and pump system arranged proximate the tool 1.

In still another embodiment (not shown) the axial movement of the rod 5 may be provided by means of for example a so-called drillpipe stroke, or a coiled tubing stroke (not shown).

The tool 1 shown in FIGS. 1*a*-3*d* is preferably operated by wireline. Alternatively, it may be operated by means of drillpipe or coiled tubing as mentioned in the paragraph above, or by means of a manipulation tool disclosed in EP 3049610, wherein the manipulation tool is connected to an end portion of a coiled tubing or drillpipe.

The tool 1 shown in FIGS. 4*a*-7*b* may be operated by means of wireline, drillpipe or coiled tubing for penetrating the pipe wall W. If the tool 1 is operatively connected to for example a canister for housing an injection fluid, and a pump for flowing the fluid from the canister to the tool 1, the tool 1 can be operated on wireline only. However, if a large volumes of injection fluid is required for a specific operation, the fluid should be supplied from a surface. In such a situation, at least the step of injecting the fluid is provided by means of coiled tubing or drillpipe. Thus, in such a situation, the tool 1 may first be operated on wireline for penetrating the pipe wall W, whereupon the wireline is retrieved and replaced by said coiled tubing or drillpipe. Alternatively, the tool 1 is operated on coiled tubing or drill pipe for both penetrating the pipe wall and injecting the fluid.

The tool 1 shown in FIGS. 8*a* and 8*b* is preferably operated on wireline. However, it may alternatively be operated on coiled tubing or drillpipe wherein the coiled tubing is operatively connected to a rotary electric or hydraulic motor configured for engaging the neck 35 and the rotatable end portion 36 of the driving means 6.

The tool 1 shown in FIG. 9, may be operated on wireline, coiled tubing or drillpipe. If the tool 1 is operatively connected to for example a canister for housing a hydraulic fluid for operating the hydraulic piston 40, and a pump for flowing the fluid to and from the hydraulic piston 40, the tool 1 can be operated on wireline only. Alternatively, the tool 1 may be operated on coiled tubing or drill pipe configured for controlling the hydraulic piston 40.

It should be noted that a hydraulic piston may also be used for operating a tool provided with an influencing portion 14 as shown in FIGS. 4*a*-7*b*, configured for injecting a fluid into an annulus on an outside of the pipe P, such a tool may be operated in the same manner as discussed above with respect to FIGS. 4*a*-7*b*.

Independent of the various configurations discussed above, with respect to a longitudinal axis of the tool 1, an angle of inclination of the wedge portions of the solid wedge 12 and the wedge arm 35, is tailormade for specific needs.

For example, if it is desired to provide a tool 1 wherein the axial movement of the rod 5, and thus the relative axial movement between the first tool part 10 and the second tool part 30, is small, the angle inclination with respect to a longitudinal axis of the tool 1 may be up to for example 60°. Such an angle of inclination requires a large force for expanding or penetration a wall W of a pipe P. However, if the purpose of the influencing portions 14 is to centralize the tool 1 within the pipe P, and/or to hang-off the tool 1 in a recess or restriction, there is no need for a large force. A large angle of inclination of the wedge portions may be desired in such an application of the tool 1.

If the primary purpose of the tool 1 is to expand or penetrate a wall W of a pipe P as shown in the figures, it is preferred that said angle of inclination of the wedge portions of the solid wedge 12 and the wedge arm 32 is relatively small. In one embodiment, said angle of inclination with respect to a longitudinal axis of the tool 1 may be as small as for example 5-6°. One consequence of such an embodiment is that an axial movement of the rod 5, and thus the relative axial movement between the first tool part 10 and the second tool part 30, is large. A large movement provides a "gearing" with respect to the rotary or axial forces applied to the rod 5.

It is desired to provide complementary angles of inclination of the portion of the solid wedge 12 and a face of the wedge arm 32 configured for abutting each other. However, an angle of inclination of the face of the double wedge configured for abutting the wedge portion of the solid wedge 12, may be different from the face of the double wedge configured for urging the influencing portion 14 radially outwards. Preferably, when the finger 15 with the influencing portion 14 is near its radially outermost position, said face of the portion of the wedge arm 32 configured for urging the influencing portion 14 radially outwards is parallel with an abutting face portion of the finger 15. The reason for this is to at least reduce a bending moment at an end portion of the finger 15 carrying the influencing portion 14 when the influencing portion 14 abuts an inner surface of the pipe P.

From the disclosure herein, it will be understood that the tool 1 according to the invention may have a great operating range in that a radial extension of the influencing portion 14 may be large with respect to the radius of the tool 1. Further, the tool 1 is reliable in that it in principle comprises only two parts axially moveable with respect to each other, and in that activation and deactivation of the influencing portion(s) 14 is a result of wedges sliding with respect to each other.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A tool for at least one of gripping, expanding, and penetrating a wall of a bore, the tool comprising a first tool part and a second tool part arranged axially movable relative to each other, wherein the first tool part comprises a solid wedge, whereas the second tool part comprises at least one wedge arm;

wherein the first and second tool parts are aligned so that a tip of the solid wedge is pointed towards a tip of the at least one wedge arm;

wherein the first tool part also comprises at least one influencing portion configured to be radially movable upon contact with the at least one wedge arm of the second tool part;

wherein, when the tool is activated and the first and second tool parts are forced against each other, the at least one wedge arm is configured to be moved axially along the solid wedge so as to be forced radially outwards and thus push the at least one influencing portion radially outwards for at least one of gripping, expanding, and penetrating the wall of the bore, and wherein a tip of the at least one wedge arm is a double wedge configured to become wedged between the solid wedge and the at least one influencing portion, so that when the first and second tool parts are forced towards each other, the at least one wedge arm is urged radially outwards by the solid wedge and the at least one influencing portion is urged radially outwards by the solid wedge and the at least one wedge arm.

2. The tool according to claim 1, wherein the double wedge has a first slanted face configured to slide on the solid wedge so that the tip of the at least one wedge arm is urged radially outwards, and a second slanted face opposite the first slanted face and configured to urge the influencing portion radially outwards.

3. The tool according to claim 1, wherein a finger connects the at least one influencing portion to the first tool part.

4. The tool according to claim 3, wherein the finger is cantilevered from the first tool part.

5. The tool according to claim 3, wherein the finger is hingedly connected to the first tool part.

6. The tool according to claim 3, wherein when the tool is in an inactive position, the finger is positioned in a recess configured for housing the finger.

7. The tool according to claim 1, wherein when the tool is in an inactive position, a radial extent of the at least one influencing portion is equal to or less than a radial extent of the first tool part.

8. The tool according to claim 1, wherein the bore is a pipe; and wherein when the tool is in an active position, the at least one influencing portion is configured for expanding the wall of the pipe.

9. The tool according to claim 1, wherein the bore is a pipe; and wherein the at least one influencing portion is configured for penetrating the wall of the pipe.

10. The tool according to claim 6, wherein the finger comprises two spaced-apart finger portions providing a space for housing a portion of the solid wedge of the first tool part when the tool is in an inactive position.

11. A tool for at least one of gripping, expanding, and penetrating a wall of a bore, the tool comprising a first tool part and a second tool part arranged axially movable relative to each other, wherein the first tool part comprises a solid wedge, whereas the second tool part comprises at least one wedge arm;

wherein the first and second tool parts are aligned so that a tip of the solid wedge is pointed towards a tip of the at least one wedge arm, wherein the first tool part also comprises at least one influencing portion configured to be radially movable upon contact with the at least one wedge arm of the second tool part, wherein, when the tool is activated and the first and second tool parts are forced against each other, the at least one wedge arm is configured to be moved axially along the solid wedge so as to be forced radially outwards and thus push the at least one influencing portion radially outwards for at least one of gripping, expanding, and penetrating the wall of the bore, wherein the bore is a pipe; and wherein the at least one influencing portion is configured for penetrating the wall of the pipe, and wherein the at least one influencing portion is provided with an aperture being in fluid communication with a conduit configured for receiving an injection fluid from a source of injection fluid.

12. The tool according to claim 11, wherein a finger connects the at least one influencing portion to the first tool part, and wherein the solid wedge comprises a recess configured for housing the finger when the tool is in an inactive position.

13. A method of at least one of gripping, expanding, and penetrating a wall of a bore, the method comprising:

providing the tool according to claim 1;

connecting the tool to a control device configured for operating the tool;

running the tool into the bore and down to a desired location within the bore; and activating the tool for at least one of gripping, expanding, and penetrating the wall of the bore.

14. A method of at least one of gripping, expanding, and penetrating a wall of a bore, the method comprising:

providing a tool for at least one of gripping, expanding, and penetrating a wall of a bore, the tool comprising:

a first tool part and a second tool part arranged axially movable relative to each other, wherein the first tool part comprises a solid wedge, whereas the second tool part comprises at least one wedge arm;

wherein the first and second tool parts are aligned so that a tip of the solid wedge is pointed towards a tip of the at least one wedge arm, wherein the first tool part also comprises at least one influencing portion configured to be radially movable upon contact with the at least one wedge arm of the second tool part, wherein, when the tool is activated and the first and second tool parts are forced against each other, the at least one wedge arm is configured to be moved axially along the solid wedge so as to be forced radially outwards and thus push the at least one influencing portion radially outwards for at least one of gripping, expanding, and penetrating the wall of the bore, connecting the tool to a control device configured for operating the tool;

running the tool into the bore and down to a desired location within the bore, wherein the bore is a pipe, and wherein the tool is provided with an influencing portion provided with an aperture being in fluid communication with a conduit configured for receiving an injection fluid from a source of injection fluid;

activating the tool for at least one of gripping, expanding, and penetrating the wall of the bore; and injecting said injection fluid into an annulus defined between an outside of the pipe and a bore surrounding the pipe.

15. The tool according to claim 2, wherein a finger connects the at least one influencing portion to the first tool part.

16. The tool according to claim 4, wherein when the tool is in an inactive position, the finger is positioned in a recess configured for housing the finger.

17. The tool according to claim 5, wherein when the tool is in an inactive position, the finger is positioned in a recess configured for housing the finger.

18. The tool according to claim 1, wherein the double wedge comprises a wedge face that is slanted upwards with respect to a longitudinal axis of the at least one wedge arm, and a wedge face that is slanted downwards with respect to a longitudinal axis of the at least one wedge arm.

19. The tool according to claim 1, wherein the double wedge has an arrow-like shape.

* * * * *